US006499779B2

(12) United States Patent
Thies et al.

(10) Patent No.: US 6,499,779 B2
(45) Date of Patent: Dec. 31, 2002

(54) CRANE GEAR FOR THE TRANSPORT OF WEB ROLLS

(75) Inventors: Joerg Christian Thies, Dissen (DE); Andreas Schroedter, Ladbergen (DE)

(73) Assignee: Windmoeller & Hoelscher, Lengerich (DE)

( * ) Notice: Subject to any disclaimer, the term of this patent is extended or adjusted under 35 U.S.C. 154(b) by 0 days.

(21) Appl. No.: 09/906,739

(22) Filed: Jul. 18, 2001

(65) Prior Publication Data

US 2002/0009360 A1 Jan. 24, 2002

(30) Foreign Application Priority Data

Jul. 18, 2000 (DE) ..... 100 34 909
Aug. 28, 2000 (DE) ..... 100 42 183

(51) Int. Cl.[7] ..... B66C 1/16

(52) U.S. Cl. ..... 294/67.1; 294/67.33; 294/67.5; 294/82.35

(58) Field of Search ..... 294/67.1, 67.2–67.22, 294/67.3, 67.33, 67.4, 67.5, 68.26, 68.27, 81.3, 81.4, 81.5, 81.54, 81.56, 82.35; 414/910, 911

(56) References Cited

U.S. PATENT DOCUMENTS

| | | | | | |
|---|---|---|---|---|---|
| 1,615,115 | A | | 1/1927 | Durhan, Jr. | |
| 2,472,843 | A | * | 6/1949 | Muise | 294/67.4 |
| 3,076,673 | A | * | 2/1963 | Kaplan et al. | 294/67.33 |
| 3,314,711 | A | * | 4/1967 | Dietz et al. | 294/67.5 |
| 3,343,861 | A | * | 9/1967 | Sinicki | 294/67.3 X |
| 3,895,836 | A | * | 7/1975 | Barnes | 294/82.35 |
| 5,445,426 | A | * | 8/1995 | Sorensen | 294/67.3 |
| 6,024,394 | A | * | 2/2000 | Marler | 294/82.35 X |

FOREIGN PATENT DOCUMENTS

| | | | | |
|---|---|---|---|---|
| CH | 569 664 | | 11/1975 | |
| FR | 2 243 901 | | 4/1975 | |
| NL | 8701885 | * | 3/1989 | 294/67.33 |
| RU | 867839 | * | 9/1981 | 294/67.3 |
| RU | 992383 | * | 2/1983 | 294/67.5 |
| RU | 1237608 | * | 6/1986 | 294/67.33 |
| RU | 1472414 | * | 4/1989 | 294/67.33 |

* cited by examiner

*Primary Examiner*—Johnny D. Cherry
(74) *Attorney, Agent, or Firm*—Jacobson Holman PLLC

(57) ABSTRACT

A crane gear for the transport of web rolls with a winding core, provided with a passage hole, exhibits a support frame, which is attached to a cable and which is provided with receiving units. The support frame comprises an upper yoke carrier with legs, which point in the downward direction and whose ends are provided with hooks and from which a support rod, which is slid through the passage hole, can be suspended.

16 Claims, 5 Drawing Sheets

CRANE GEAR FOR THE TRANSPORT OF WEB ROLLS

BACKGROUND OF THE INVENTION

1. Field of the Invention

The invention relates to a crane gear for the transport of web rolls with a winding core, provided with a passage hole, preferably for the transport of paper rolls, with a support frame, attached to a cable, with receiving units.

2. Description of the Related Art

Web rolls, for example made of paper, that can exhibit a weight of one ton and more, are usually transported by means of floor conveyors, for example fork lift trucks, provided with a carrying mandrel, in order to put them, for example, into unwinding units. Paper webs are drawn off, for example, from paper rolls, suspended in unwinding units, in order to produce from them tubular sections for the purpose of producing sacks or to print on them in the printing machines. It is difficult, especially under crowded room conditions, to maneuver a roll of paper hanging from a receiving mandrel of a fork lift truck.

The invention proceeds from the recognition that in the typical operations and production halls there are cranes, which can be moved to arbitrary places in the halls. Moreover, it is easier to maneuver the paper rolls, hanging from a crane hook; and thus it is easier to transport them to the unwinding units and optionally they may be conveyed away from the unwinding units.

SUMMARY OF THE INVENTION

Therefore, the object of the invention is to provide a crane gear of the class described in the introductory part of the specification, into which it is easy to suspend the web rolls and from which it is easy to remove again the web rolls from the same.

The invention solves this problem in that the support frame of the crane gear comprises an upper yoke carrier with legs, which project in the downward direction and whose ends are provided with hooks. A support rod, slid through the passage hole, can be suspended from the legs. Thus, the inventive crane gear comprises in its simplest design a U-shaped support frame with downwardly projecting legs, with which the ends of the support rod that protrude on both sides beyond the passage hole of the web roll can be coupled together.

For the purpose of attaching the web roll to the support frame and also of uncoupling it again from the same, a preferred embodiment provides that the yoke carrier has a passageway therethrough in which a boom rod can be slid. One end of the boom rod that projects beyond the yoke carrier is connected to a support arm, projecting in the downward direction. One end of the support rod can be coupled to the support arm, while the other end of the support rod lies in such a manner in the hook of a leg that the support rod can be forced into engagement with the hook of the other leg by moving the support arm and the boom rod through the passageway in the yoke carrier. In this inventive improvement, the outer end of the support rod is connected to the support arm of the extended boom rod, whereby the other end of the support rod rests in the hook of a leg so that the crane gear can be aligned in such a manner in relation to the paper roll over the crane that the support rod lies in front of the passage hole and aligns with said hole. By simply moving the support arm with boom, the support rod can be slid in such a manner through the passage hole of the web roll that it engages in such a manner with the hook of the other leg that the legs enclose the paper roll and the support rod is suspended from the hooks.

The eye of the crane gear is located in principle in the vertical center plane between the legs of the support frame. If, however, the boom is extended to one side, said boom exerts on the support frame a moment that tries to swing the support frame into an inclined position, in which it is difficult to simply attach the web roll. Therefore, a further development of the present invention provides that a guide rod, which runs parallel to the yoke carrier, is attached to the brackets of the yoke carrier. On the guide rod can be site a counterweight, which is connected in such a manner to the boom rod by means of connecting means that the crane gear is located, in almost all outward thrust positions of the boom rod, essentially in the balance of moments about a horizontal cross axis, running through the eye. Thus, a support frame that is provided with the inventive counterweight can be coupled in a simple manner to the web roll, because in every position of the boom the legs, provided with hooks, are located, as a rule, in their vertical position.

Preferably the connecting means comprise a cable, whose ends are fastened to the yoke carrier or the brackets and whose strands are reeved, like a block and tackle, on both sides of a fixed point to the boom rod between rollers, located on both sides of the counterweight and the yoke carrier or the brackets. In this design the counterweight is automatically coupled in such a manner to the boom rod by means of the cable reeving that, when the boom rod is moved, the counterweight exerts a movement, opposite the movement of the boom rod.

BRIEF DESCRIPTION OF THE DRAWINGS

One embodiment of the invention is explained in detail below with reference to the drawings.

DETAILED DESCRIPTION OF THE PREFERRED EMBODIMENTS

Figure 1:
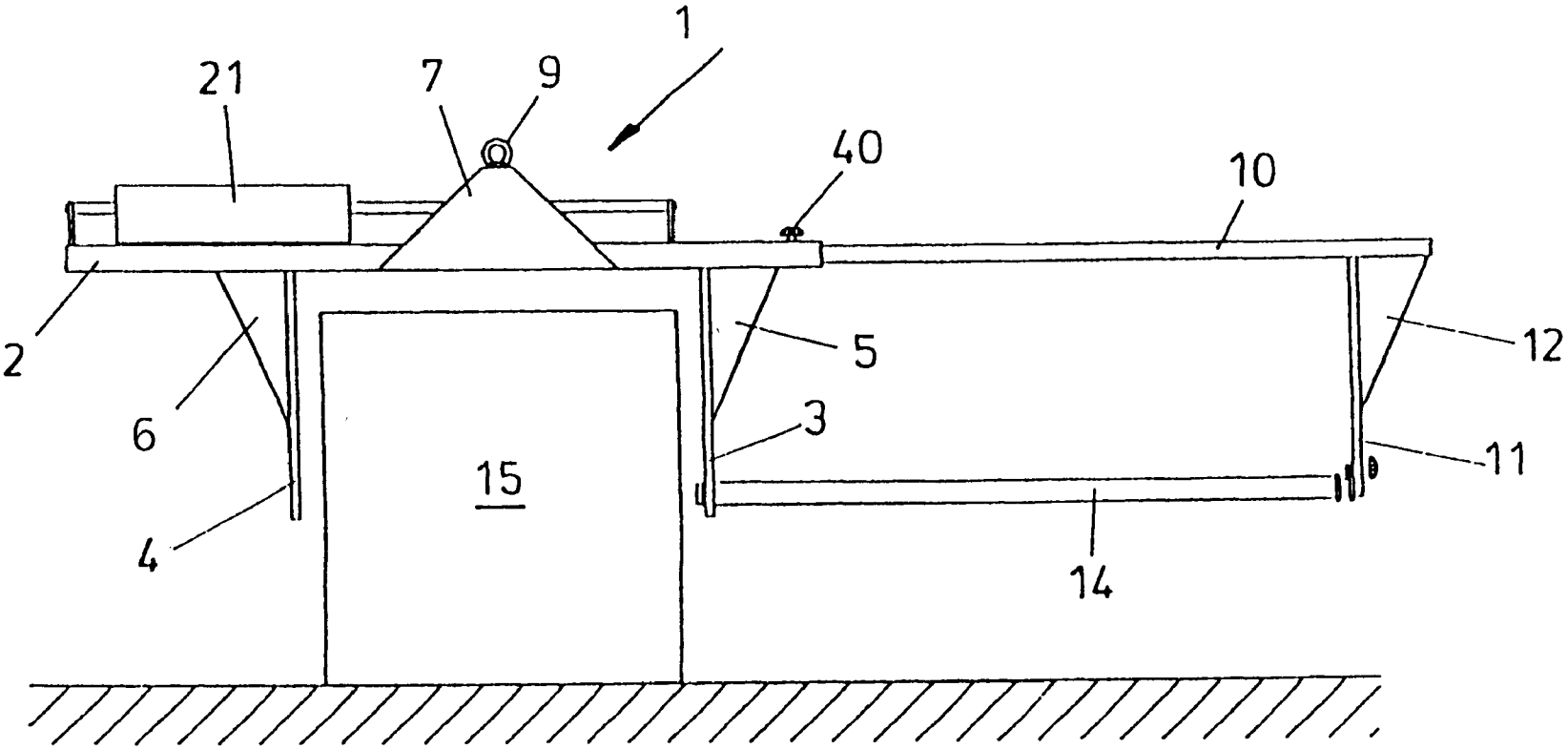
FIG. 1 is a front view of the crane gear with extended boom rod.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The crane gear 1 exhibits a support frame, which comprises an upper yoke carrier 2, which is welded at right angles to the legs 3, 4, pointing in the downward direction. The yoke carrier is made from a hollow profile, for example a box profile. For reinforcement, triangular reinforcement plates 5, 6 are welded on the outsides of the legs 3, 4 to said legs and the yoke carrier 2. On both sides the yoke carrier 2 projects beyond the leg 3, 4. In the center between the legs 3, 4 the yoke carrier is welded to triangular brackets 7, whose upper ends are connected together by means of a cross member 8, which exhibits the eye 9, from which a crane hook can be suspended.

The yoke carrier 2 exhibits a boom rod 10 with a complementary profile, whose end, projecting beyond the yoke carrier 2, is welded at right angles to a support arm 11, which is reinforced by means of a welded reinforcement plate 12 in relation to the boom rod 10.

Figure 2:
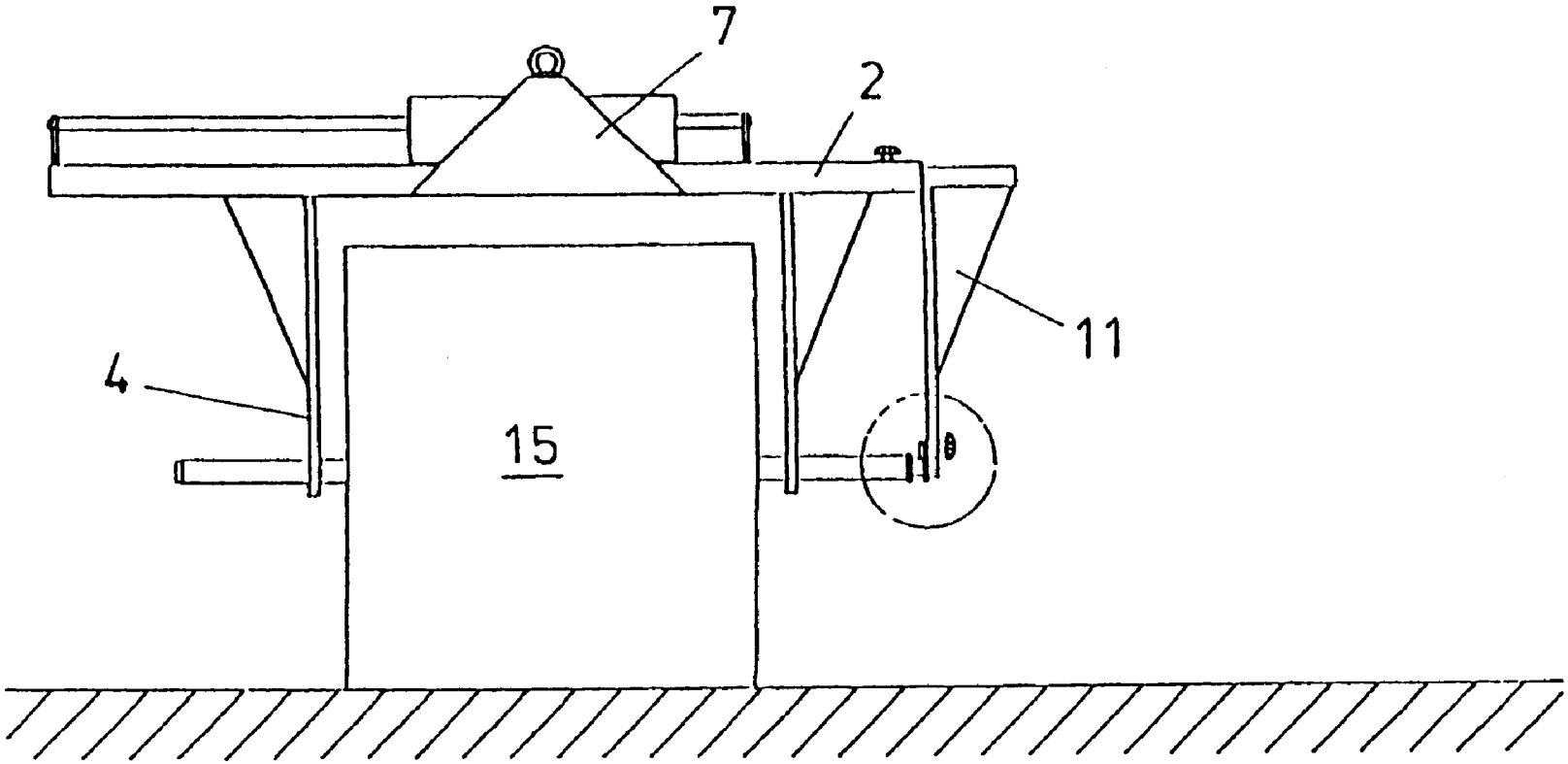
FIG. 2 is a view of the crane gear that corresponds to that of FIG. 1, with retracted boom rod and support rod, inserted into the hooks of the crane gear.
Figure 3:
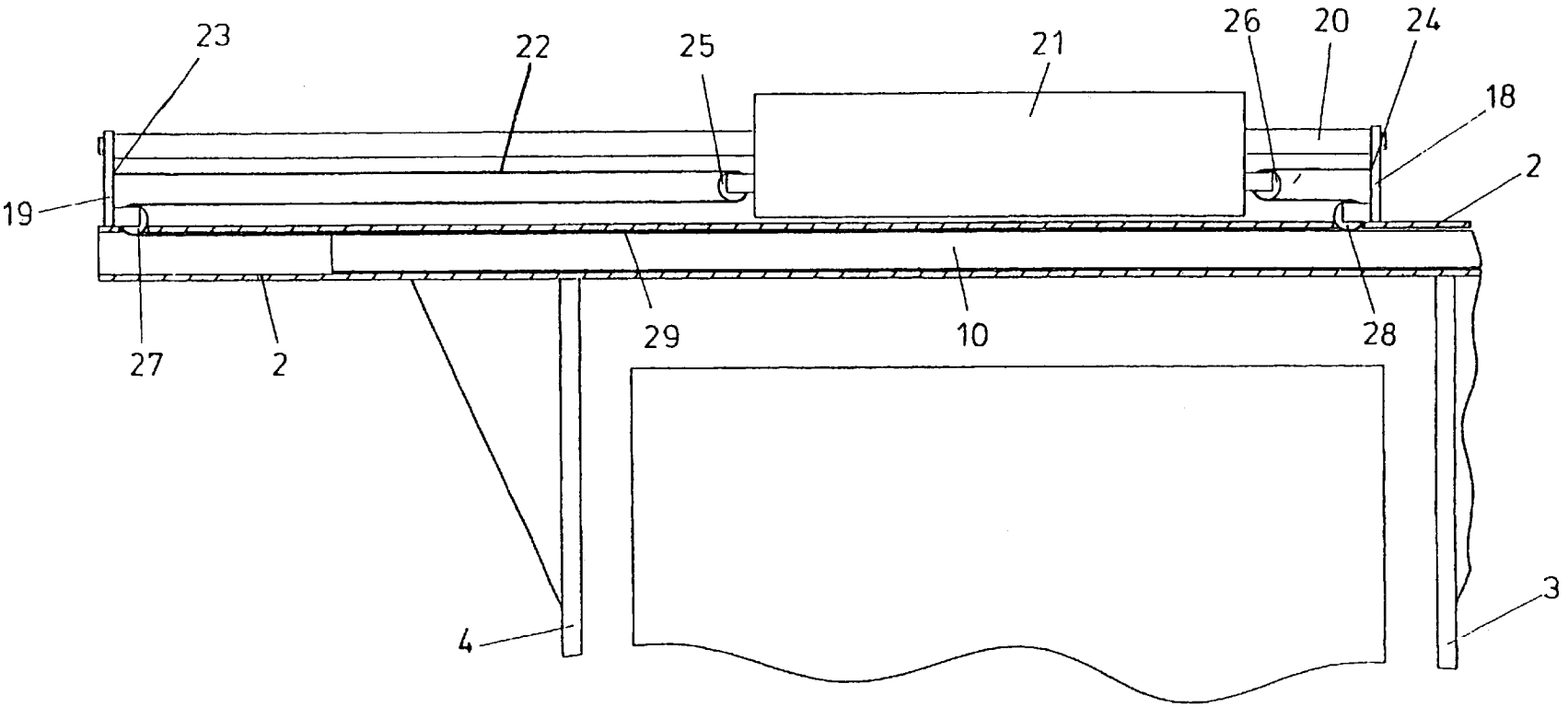
FIG. 3 is a sectional view through the yoke carrier of the support frame with a counterweight, which can be moved on the guide rod.
Figure 4:
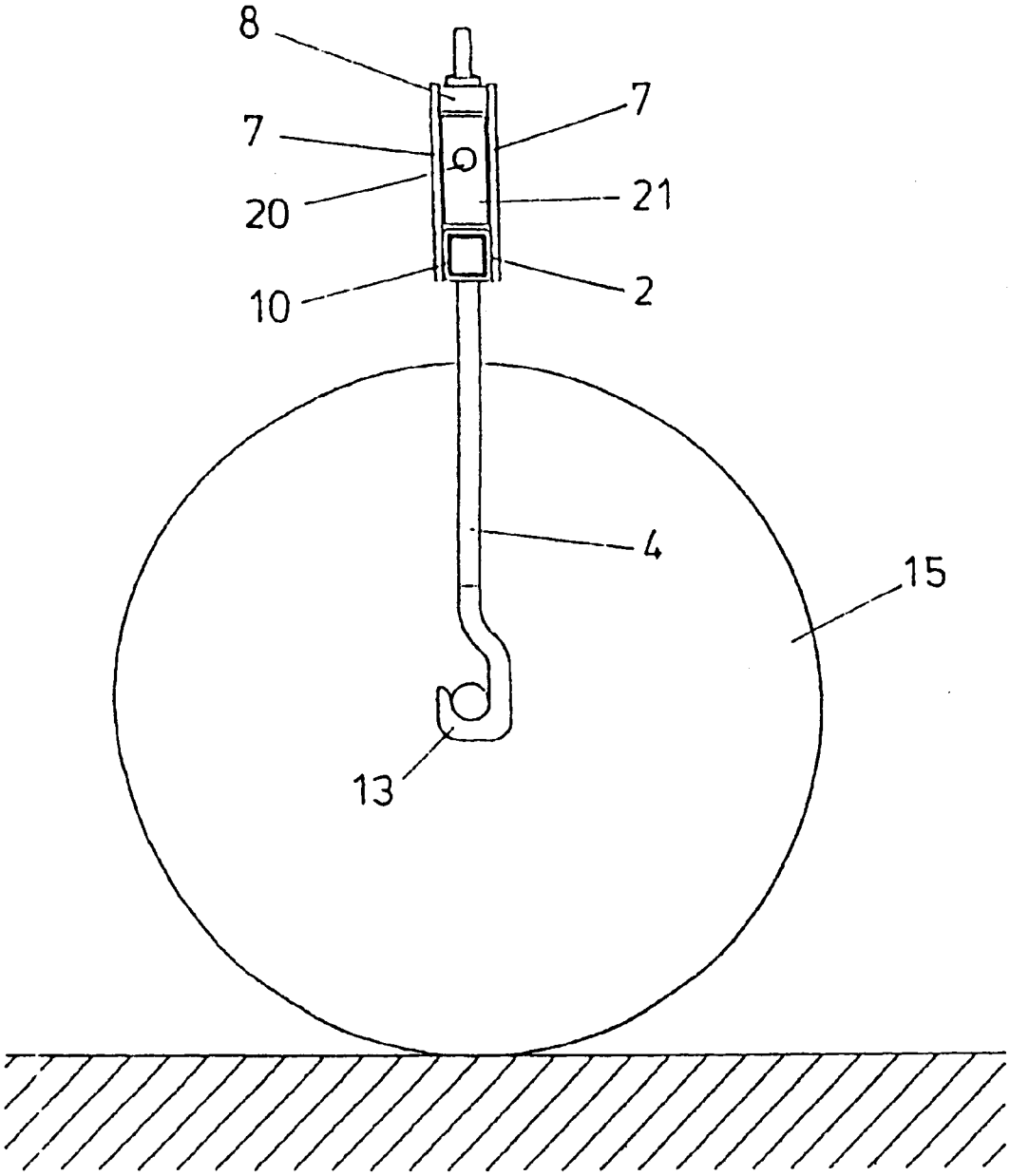
FIG. 4 is a side view of the crane gear in accordance with FIGS. 1 and 2.

The bottom ends of the legs 3, 4 are provided with hooks 13. A support rod 14 can be slid or hooked and/or unhooked into the hooks 13. To slide into or through a passage hole of the winding arm of the web roll 15, said support rod is coupled in such a manner, as shown in FIG. 1, to the bottom end of the support arm 11 that the opposite end of the support rod 14 rests in the hook 13 of the leg 3. To receive the web roll 15, the support frame is moved by means of the crane into a position to the web roll, in which the support rod 14 aligns with the passage hole of the winding core. After this alignment the boom rod 10 can be inserted into the passageway with the support arm 11 so that the front end area of the support rod is slid, as depicted in FIG. 2, through the hook 13 of the leg 4 so that the web roll 15 is coupled, as shown in FIG. 2, to the crane gear.

The upper side of the yoke carrier 2 is welded to the brackets 18, 19, of which the bracket 19 is located on the end area of the end of the yoke carrier 2 that projects beyond the leg 4. A guide rod 20, which runs parallel to the yoke carrier 2, is held in the brackets 18, 19. A counterweight 21 can be slid longitudinally along this guide rod 20. To enable a low friction displacement, the counterweight 21 can be provided in a passage hole with spherical sleeves, by means of which the counterweight is guided on the guide rod 20. To slide the counterweight 21 on the guide rod 20, there is a cable reeving along the line of a block and tackle. This cable reeving comprises a belt or a cable 22, whose ends are attached to the fixed points 23, 24 of the brackets 18, 19. The counterweight 21 is provided on the opposite sides with forked bearing legs, in which the guide rollers 25, 26 can be freely rotated. In the base area of the brackets 18, 19 there are guide rollers 27, 28, which can be freely rotated between the forked bearing legs. These guide rollers penetrate in recesses the upper wall so that the bottom strands of the cable 22 run inside the yoke carrier. The cable 22 is connected inside the yoke carrier 2 to the boom rod 10 at a fixed point 29.

The left strand of the cable 22 runs from this fixed point 29 over the deflecting rollers 27, 25 to the fixed point 23 on the bracket 19. The right strand of the cable 22 runs from the fixed point 29 to the boom rod 10 over the deflecting rollers, 28, 26 to the fixed point 24 on the right bracket 18. This described reeving of the cable 22 guarantees that the counterweight executes a movement opposite to that of the boom rod when the boom rod 10 is moved.

The cable reeving and the configuration of the counterweight 21 on the guide rod 20 are chosen in such a manner that the counterweight generates in every position of the boom rod 10 an identically large, but opposite torque about the eye 9 so that the legs 3, 4, attached at right angles to the yoke carrier 2, always remain in their perpendicular position. Thus, this arrangement makes it easy to couple the crane gear to the web roll to be received.

Figure 5:
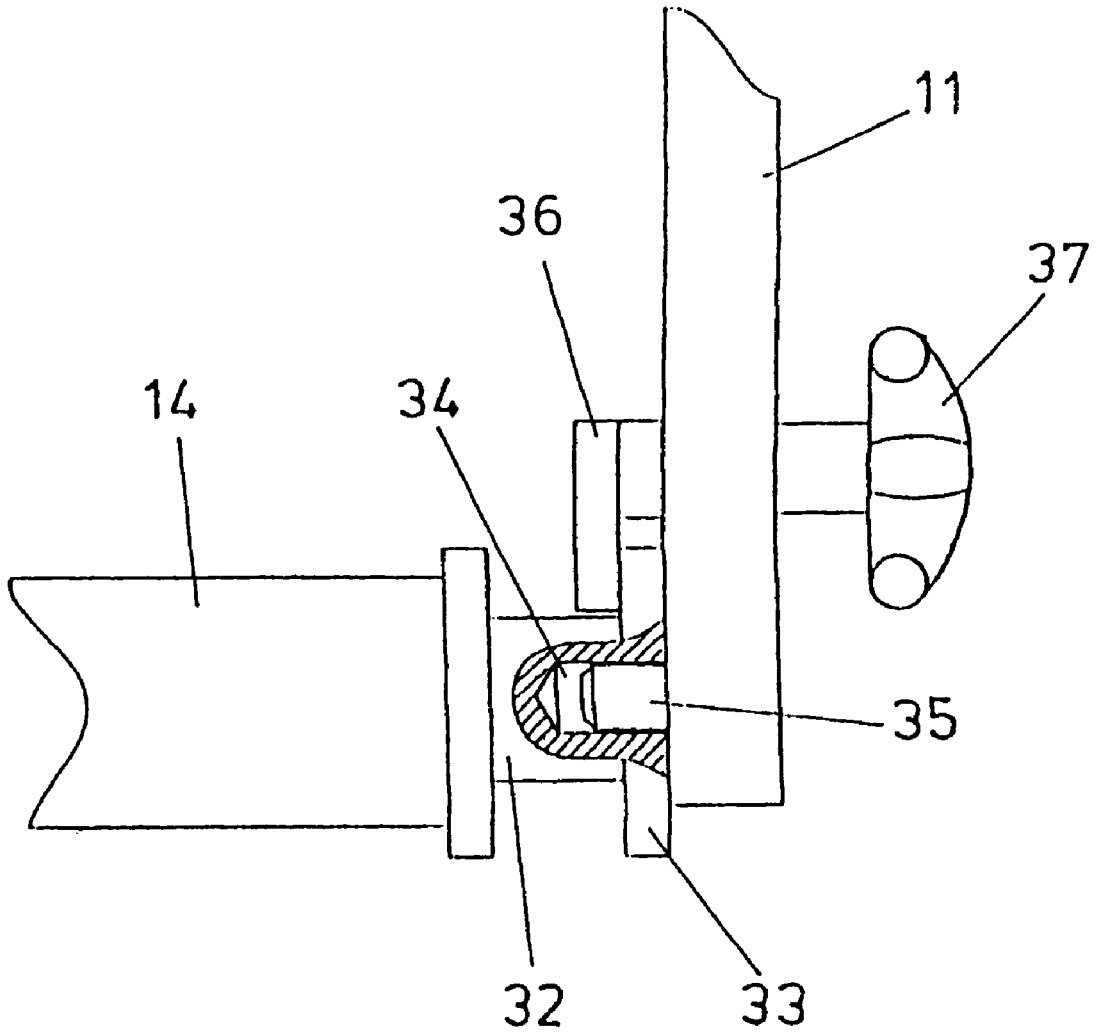
FIG. 5 is a side view of the coupling between the support arm and the support rod, partially cut.

As apparent from FIG. 5, the right end of the support rod 14 exhibits a section 32, whose cross section tapers off and whose end bears a flange-shaped disk 33. The tapered section 32 is provided with an axial blind hole 34, with which a pin 35 interacts that is welded to the bottom end area of the support arm 11. In the support arm 11 there is a rotatable bolt 36 above the pin 35. To actuate said bolt, it is provided with a knob 37 and can be rotated between its locking position, which is depicted in FIG. 5, and its unlocking position-releasing the flange 33. To lock, the pin 35 is slid into the borehole 34. Unlocking is done by releasing the flange 33 by means of the bolt 36 so that the pin 35 can be pulled out of the borehole 34.

A setscrew 40, provided with a knob, can be screwed into a threaded borehole of the yoke carrier 2. The boom rod 10 can be fixed into its retracted and extended position by means of said setscrew.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A crane gear for the transport of a web roll provided with a passage hole, comprising:

an upper yoke carrier having a first leg and a second leg projecting downwardly therefrom and adapted to receive a web roll therebetween, each of said first and second legs being provided with a holding portion;

a boom rod moveable within said yoke carrier and having an end which projects beyond said yoke carrier on a side of said yoke carrier nearest said first leg;

a support arm extending downwardly from said projecting end of said boom rod; and a support rod coupled at a first end to said support arm and supported at a second end by the holding portion of said first leg such that said second end can be forced into engagement with the holding portion of said second leg by moving the boom rod toward said yoke carrier to pass said support rod through the passage hole of the web roll.

2. The crane gear as set forth in claim 1, wherein said yoke carrier includes a guide rod running substantially parallel therewith and supporting a counterweight which is connected to said boom rod so as to move in opposition therewith such that in extended positions of said boom rod said crane gear remains essentially in a balance of moments about a horizontal cross axis.

3. The crane gear as set forth in claim 2, wherein said counterweight is connected to said boom rod by a cable.

4. The crane gear as set forth in claim 3, wherein ends of said cable are fastened to the yoke carrier and strands of said cable are reeved on both sides of a fixed point to said boom rod between rollers located on both sides of said counterweight and on both sides of said yoke carrier.

5. The crane gear as set forth in claim 1, wherein said support rod is releasably connected to said support arm by a rotatable bolt.

6. The crane gear as set forth in claim 1, wherein said yoke carrier includes a set screw passing therethrough for fixing said boom rod in a desired position.

7. The crane gear as set forth in claim 1, wherein said holding portions are embodied as hooks and said first and second legs are substantially perpendicular to said yoke carrier.

8. A crane gear for the transport of a web roll provided with a passage hole, comprising:

an upper yoke carrier having a first leg and a second leg projecting downwardly therefrom and adapted to receive a web roll therebetween, each of said first and second legs being provided with a holding portion;

a support rod suspended from said holding portions and substantially parallel with said yoke carrier, said support rod adapted to move from an extended position projecting beyond said yoke carrier to a position substantially aligned therewith by sliding through the passage hole to support a web roll situated between said legs; and a guide rod running substantially parallel with said yoke carrier and supporting a counterweight which moves in opposition to said support rod such that, in the extended position of said support rod, said crane gear remains essentially in a balance of moments about a horizontal cross axis.

9. The crane gear as set forth in claim 8, further comprising:

a boom rod moveably fitted within a passageway of said yoke carrier and having an end which projects beyond said yoke carrier; and a support arm extending downwardly from said projecting end of said boom rod;

said support rod coupled at a first end to said support arm and supported at a second end by at least one of said holding portions.

10. The crane gear as set forth in claim 9, wherein said boom rod projects beyond said yoke carrier adjacent said first leg such that said second end of said support rod is supported by the holding portion of said first leg when said support rod is in said extended position, said second end being forced into engagement with the holding portion of said second leg by moving the boom rod within said passageway toward said second leg to pass said support rod through the passage hole of the web roll.

11. The crane gear as set forth in claim 9, wherein said counterweight is connected to said boom rod by a cable.

12. The crane gear as set forth in claim 1, wherein ends of said cable are fastened to the yoke carrier and strands of said cable are reeved on both sides of a fixed point to said boom rod between rollers located on both sides of said counterweight and on both sides of said yoke carrier.

13. The crane gear as set forth in claim 9, wherein said support rod is releasably connected to said support arm by a rotatable bolt.

14. The crane gear as set forth in claim 9, wherein said yoke carrier includes a set screw passing therethrough for fixing said boom rod in a desired position.

15. The crane gear as set forth in claim 9, wherein said first and second legs are substantially perpendicular to said yoke carrier and substantially parallel with said support arm.

16. The crane gear as set forth in claim 8, wherein said holding portions include hooks and said first and second legs are substantially perpendicular to said yoke carrier.

* * * * *